US006447561B1

(12) United States Patent
Winter et al.

(10) Patent No.: US 6,447,561 B1
(45) Date of Patent: Sep. 10, 2002

(54) ABRASIVE BODY

(75) Inventors: Ernst Michael Winter; Hans-Joachim Wiemann, both of Hamburg (DE)

(73) Assignee: Winter CVD Technik GmbH (DE)

( * ) Notice: Subject to any disclaimer, the term of this patent is extended or adjusted under 35 U.S.C. 154(b) by 11 days.

(21) Appl. No.: 09/612,824

(22) Filed: Jul. 10, 2000

Related U.S. Application Data

(63) Continuation-in-part of application No. 09/142,899, filed on Sep. 14, 1998, now abandoned.

(51) Int. Cl.[7] ..... B24D 3/00; B24D 11/00; B24D 11/02; B24D 18/00

(52) U.S. Cl. ..... 51/297; 51/295; 51/307; 51/309; 427/457; 427/248.1; 427/249.8; 427/249.9; 205/110; 205/159; 205/160; 205/316

(58) Field of Search ..... 51/293, 295, 297, 51/307, 309; 427/457, 248.1, 249.8, 249.9; 205/80, 110, 160, 159, 316

(56) References Cited

U.S. PATENT DOCUMENTS

| | | | | | |
|---|---|---|---|---|---|
| 5,131,924 | A | * | 7/1992 | Wiand | 51/293 |
| 5,221,293 | A | * | 6/1993 | Ferlemann et al. | 51/309 |
| 5,344,688 | A | * | 9/1994 | Peterson et al. | 51/309 |
| 5,358,741 | A | * | 10/1994 | Gat | 51/295 |
| 5,560,753 | A | * | 10/1996 | Schnabel et al. | 51/309 |

FOREIGN PATENT DOCUMENTS

| | | | |
|---|---|---|---|
| JP | 63144968 | * | 6/1988 |

* cited by examiner

*Primary Examiner*—Michael Marcheschi
(74) *Attorney, Agent, or Firm*—R W Becker & Associates; R W Becker

(57) ABSTRACT

An abrasive body for grinding optical glass, precious and natural stones such as marble, or other material such as wood, metal, plastic or the like is provided. The abrasive body comprises a base body of woven, knitted or embroidered fabric made of carbon fibers, or of a graphite foil. A uniform, homogeneous diamond or boron nitride coating is deposited on the base body as a grinding layer.

9 Claims, 1 Drawing Sheet

ABRASIVE BODY

The present application is a Continuation-in-Part of U.S. patent application Ser. No. 09/142,899 filed Sep. 14, 1998 abandoned.

BACKGROUND OF THE INVENTION

The present invention relates to an abrasive body for grinding optical glass, precious stones, marble or other materials such as wood, metal, plastic or the like. In particular, the present invention relates to abrasive bodies in the form of a ductile, thin, sheet-like base body that is coated with a grinding material for grinding optical glass, especially spectacle lenses. The following is therefore predominantly directed to spectacle lenses, without however thereby limiting the use of the abrasive bodies.

To grind optical glass, it is known to use metal foils of 0.1 to 0.5 mm thickness in which are embedded diamond particles. These metal foils generally comprise a low alloy bronze having a tin content of less than 10%. Such foils are consequently ductile and merely by being pressed on adapt to the given receiving radius of an optical fine grinding machine. These foils can be used on both sides as abrasive bodies since they are completely permeated with diamond particles in the appropriate concentration. In this connection, the diamond particles have a granular size of preferably 5 to 30 $\mu$m. During the grinding process the abrasive bodies wear away and a mixture of glass dust, heavy metal powder and diamond powder results as grinding residue. Obviously, the disposal of such a residue, especially due to the heavy metal, presents considerable problems.

It is therefore an object of the present invention to provide an abrasive body for the aforementioned purposes that avoids the problem of disposal.

SUMMARY OF THE INVENTION

This object is realized pursuant to the present invention in that the base body of the abrasive body comprises a woven, knitted or embroidered fabric made of carbon fibers, or of a graphite foil, upon which a uniform, homogeneous diamond or boron nitride coating is deposited as a grinding layer. This has the advantage that a grinding residue results that merely contains diamond powder, carbon or graphite dust, and dust from the material of the object that is to be ground, for example glass dust, which can be disposed of in a non-polluting manner. A recycling of the glass dust together with the diamond powder and carbon and graphite dust is readily possible. Abrasive bodies manufactured using the inventive base bodies, which can have the same thickness of 0.1 to 0.5 mm as the conventional bronze foils, offer the further advantage that they can readily be utilized as replacement products for the known metallic abrasive bodies. The woven, knitted or embroidered fabric made of carbon fibers, or the graphite foils, are elastic just like metal foils since the diamond or boron nitride coating is only deposited upon the fibers of the woven, knitted or embroidered fabric, or upon the surface of the graphite foil, and can hence be appropriately shaped.

The diamond or boron nitride coating is preferably applied to the base body, possibly on both sides thereof, by gas phase precipitation. As a result of this process, which is also known as CVD (chemical vapor deposition), a very thin and homogeneous coating can be produced. The coating can also be deposited upon the base body by galvanic deposition, expeditiously accomplished in a fluidized bed tank. The coating can, for example, have a thickness on one or both sides of 5 to 50 $\mu$m. An important feature of the present invention is that regardless of how the coating is applied, it is a uniform and homogeneous layer in which no grinding particles or granules are embedded.

To improve the adhesion of the diamond or boron nitride coating to the material of the base body, it is furthermore possible to provide a preferably galvanically applied intermediate layer of precious metal, for example gold, silver, platinum or iridium, between the base body and the diamond coating.

In principle, the abrasive body can have any desired shape and is essentially a function of the shape of the receiving means of the processing machine for the abrasive body as well as the shape of the workpiece to be processed. For example, for processing precious stones or marble the abrasive body can be a ring.

The base bodies of the abrasive bodies can be appropriately made of conventional woven, knitted or embroidered fabric made of carbon fibers, or of graphite foil, in any desired shape in conformity with the respective requirements. At least one surface of the finished base body is then, for example via a CVD process, provided with a thin diamond or boron nitride coating, whereby prior to the application of the diamond or boron nitride coating upon the surface of the base body, which is to carry the diamond or boron nitride coating, a thin precious metal layer as an adhesive agent and for stress compensation can additionally be galvanically applied between the base body and the diamond coating. The coated abrasive bodies are then secured to a carrier member, such as a grinding disk, in a conventional manner, for example by being glued thereto. However, the coated abrasive bodies can also be used as an abrasive paper without fastening them to the carrier member.

During the grinding process the thin diamond coating is worn down in a manner known per se, so that the base body is exposed. Thereafter the workpiece can no longer be ground, as a result of which wear of the abrasive body is also foreseeable. The abrasive bodies must then be replaced. The waste product, the used-up abrasive body, then comprises only graphite foil or carbon fibers and can be directly disposed of with the normal trash. There is thus eliminated not only the expensive heavy metal removal of the known abrasive bodies of metal foils, but in addition no chemical removal processes that pollute the environment are required. The used base bodies can also be recoated. Waste products in the quantities that occur with the known products are therefore avoided.

BRIEF DESCRIPTION OF THE DRAWING

Specific embodiments of the invention will be described in detail in the following with the aid of the accompanying schematic drawing, in which.

DESCRIPTION OF THE PREFERRED EMBODIMENTS

Figure 1:
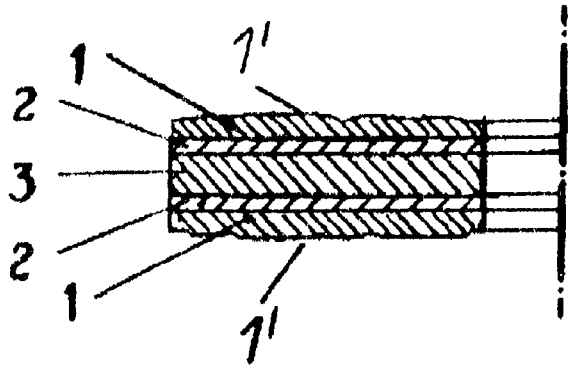
FIG. 1: a cross-sectional view of one exemplary embodiment of an inventive abrasive body.

The abrasive body illustrated in FIG. 1 has a base body 3 made of a woven, knitted or embroidered fabric made of carbon fibers, or of a graphite foil. The base body 3 is provided on both sides, via a CVD process, with a thin uniform, homogeneous diamond coating 1 as an outer layer. Provided between the diamond coating 1 and the base body 3 is in addition a thin intermediate precious metal layer 2 as an adhesive agent. These abrasive bodies can be secured on a non-illustrated carrier member, for example a grinding disk for optical glass, or can also be utilized as a conventional abrasive paper.

Figure 2:
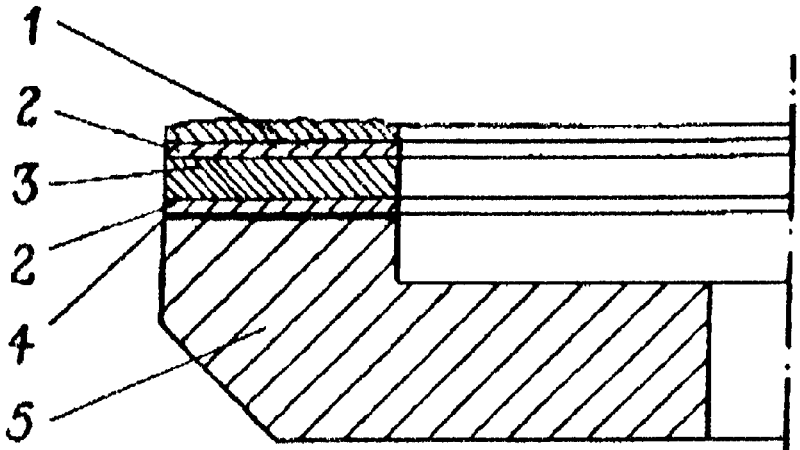
FIG. 2: a cross-sectional view of a grinding disk having disposed thereon an inventive annular abrasive body.

With the grinding disk illustrated in FIG. 2, which is preferably designed for working precious stones, an annular abrasive body is secured via an adhesive layer 4 to the rim of a metal disk 5, which is held on a rotatable spindle or arbor (not shown). The abrasive body comprises an inner base body 3 of woven, knitted or embroidered fabric made of carbon fibers, or of a graphite foil, on both sides of which is galvanically deposited a thin intermediate precious metal layer 2. That surface of the base body 3 remote or facing away from the metal disk 5 carries a diamond coating 1 that is applied pursuant to the CVD method.

Figure 3:
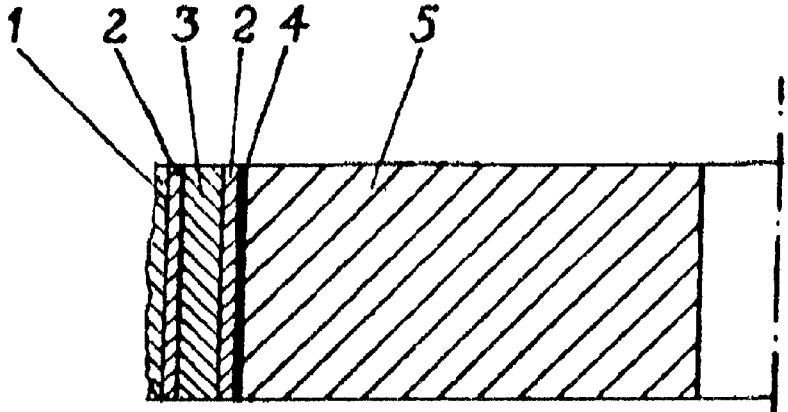
FIG. 3: a cross-sectional view of a grinding wheel having an inventive abrasive body disposed on its outer surface.

FIG. 3 shows a metal grinding wheel 5, the outer surface of which carries an adhesive layer 4 upon which is held an inventive abrasive body. The abrasive body itself comprises a base body 3, which is made of a woven, knitted or embroidered fabric made of carbon fibers or of a graphite foil, and is galvanically coated with a thin intermediate precious metal layer 2. That surface of the base body 3 that is remote from the metallic grinding wheel 5 carries a uniform, homogeneous boron nitride coating 1 that is applied pursuant to the CVD method.

The surface of the diamond or boron nitride coating 1 that is deposited upon the base body 3 preferably has an uneven outer surface 1' (FIG. 1). As a consequence, the inventive abrasive body surprisingly has a very good grinding quality that heretofore known abrasive material can achieve only by having abrasive particles embedded in or on a carrier material.

The present invention is not limited to the illustrated and described embodiments. It includes modifications familiar to one skilled in the art. For example, in particular a plurality of annular abrasive bodies, between which diamond impregnations are provided, can be disposed on a grinding disk. The rim region of the grinding disk can also be provided with the diamond impregnation, which is adjoined toward the center of the disk with annular abrasive bodies. The annular abrasive bodies can also be held on the rim of cup-shaped grinding plates or disks, whereby the surface of the abrasive bodies that carry the diamond coating can be curved.

The specification incorporates by reference the disclosure of German priority documents 297 00 388.7 of Jan. 13, 1997 and 297 1 1 063.2 of Jun. 25, 1997 as well as European priority document PCT/EP98/00107 of Jan. 10, 1998.

The present invention is, of course, in no way restricted to the specific disclosure of the specification and drawings, but also encompasses any modifications within the scope of the appended claims.

What we claim is:

1. An abrasive body for grinding an article, comprising:

a base body comprising either (a) woven, knitted or embroidered fabric made of carbon fibers, or (b) a graphite foil; and a homogeneous diamond or boron nitride coating deposited on said base body as a grinding layer, wherein the base body contains no embedded grinding particles.

2. An abrasive body according to claim 1, wherein said diamond or boron nitride coating is deposited on said base body by gas phase precipitation.

3. An abrasive body according to claim 1, wherein said diamond or boron nitride coating is deposited on said base body by galvanic deposition.

4. An abrasive body according to claim 1, wherein said diamond or boron nitride coating has a thickness of from 5 to 50 $\mu$m.

5. An abrasive body according to claim 1, wherein a thin intermediate layer of precious metal is provided between said base body and the diamond or boron nitride coating.

6. An abrasive body according to claim 5, wherein said precious metal is gold, silver, platinum or iridium.

7. An abrasive body according to claim 5, wherein said precious metal intermediate layer is galvanically deposited upon said base body.

8. An abrasive body according to claim 1, wherein said diamond or boron nitride coating has an uneven outer surface.

9. A method of producing an abrasive body, including the steps of:

providing a base body comprises either (a) woven, knitted or embroidered fabric made of carbon fibers, or (b) a graphite foil; and depositing on said base body, by gas phase precipitation or galvanic deposition, a homogeneous diamond or boron nitride coatings, wherein the base body contains no embedded grinding particles.

* * * * *